United States Patent [19]

Nakamura et al.

[11] Patent Number: 4,767,316

[45] Date of Patent: Aug. 30, 1988

[54] FUEL SUPPLY SYSTEM FOR OIL BURNER

[75] Inventors: Kazuharu Nakamura; Motoki Matsumoto; Osamu Niwa; Yoshimasa Tsuboi, all of Aichi, Japan

[73] Assignee: Toyotomi Kogyo Co., Ltd., Aichi, Japan

[21] Appl. No.: 4,400

[22] Filed: Jan. 20, 1987

[30] Foreign Application Priority Data

Jan. 29, 1986 [JP] Japan ..... 61-011339[U]

[51] Int. Cl.[4] ..... F23D 14/50

[52] U.S. Cl. ..... 431/121; 126/95; 431/13; 431/33

[58] Field of Search ..... 126/95, 96; 431/29, 431/30, 121, 13, 33

[56] References Cited

U.S. PATENT DOCUMENTS

| | | | |
|---|---|---|---|
| 3,276,508 | 10/1966 | Stierlin | 431/121 X |
| 3,408,152 | 10/1968 | Cole | 431/89 |
| 4,504,214 | 3/1985 | Stahl et al. | 431/121 |
| 4,688,546 | 8/1987 | Akita et al. | 126/96 |

FOREIGN PATENT DOCUMENTS

| | | | |
|---|---|---|---|
| 128271 | 8/1985 | Japan . | |
| 170853 | 10/1986 | Japan . | |
| 746068 | 3/1956 | United Kingdom | 431/121 |
| 908973 | 10/1962 | United Kingdom | 126/96 |

*Primary Examiner*—Samuel Scott
*Assistant Examiner*—Allen J. Flanigan
*Attorney, Agent, or Firm*—Pollock, Vande Sande & Priddy

[57] ABSTRACT

The fuel supply system includes an air pipe which is connected between a fuel oil supply pipe and an inlet side of a forced air passage and is provided at a middle portion thereof with an elevation positioned above any portion of the fuel supply pipe between the air pipe and a pot of the oil burner. The fuel supply system may include an outflow prevention mechanism wherein the elevation formed at the air pipe is above the elevation of the fuel supply pipe and a return pipe, and the return pipe has an elevation positioned between the elevation of the air pipe and that of the fuel supply pipe and is connected between the oil reservoir and the fuel supply pipe.

11 Claims, 6 Drawing Sheets

FUEL SUPPLY SYSTEM FOR OIL BURNER

BACKGROUND OF THE INVENTION

1. Field of the Invention

This invention relates to a fuel supply system for an oil burner, and more particularly to a fuel supply system for an oil burner which is adapted to prevent the generation of bad odor due to fuel oil remaining in a fuel supply pipe during fire-extinguishing operation of the oil burner.

2. Description of the Prior Art

A conventional oil burner which is adapted to feed fuel oil and combustion air to a combustion section such as a pot by means of a fuel supply pipe and an air fan, respectively, is generally constructed to carry out fire-extinguishing instantly by closing a fuel valve and turning off the air fan. However, such construction causes the supply of fuel oil and combustion air to be stopped simultaneously with the fire-extinguishing operation, resulting in fuel oil remaining in the fuel supply pipe. Also, the oil burner is still kept at a high temperature and a strong draft is still formed in the oil burner immediately after the fire-extinguishing, so that the fuel oil remaining in the fuel supply pipe may be gradually vaporized and discharged to the pot. The so-discharged fuel oil is decomposed in the oil burner which remains at a high temperature, thus generating bad odor. In order to overcome such a problem, it has been proposed that the fuel supply pipe is provided at a tip end thereof with a nozzle pipe to decrease the amount of fuel oil remaining in fuel supply pipe. The provision of such a nozzle pipe has also been desired in order to provide an oil burner of a low quantity of heat. Nevertheless, such a construction is still insufficient to prevent the generation of a bad odor.

Accordingly, it would be highly desirous to develop an oil feed system for an oil burner which is capable of effectively preventing the generation of a bad odor during and after a fire-extinguishing operation of the oil burner.

SUMMARY OF THE INVENTION

Briefly speaking, in accordance with the present invention, a fuel supply system is provided which is adapted to be used for an oil burner which includes an oil reservoir, a combustion section such as a pot, an air passage and an air fan for forcibly supplying combustion air through the air passage to the combustion section. The fuel supply system includes a fuel supply pipe connected between the oil reservoir and the combustion section, and a pumping means for drawing fuel oil from the oil reservoir to the fuel supply pipe and for feeding fuel oil therethrough to the combusion section. The fuel supply system also includes an air pipe connected at one end thereof to the fuel supply pipe through a connection formed therebetween and at the other end thereof to an inlet side of the air passage. The air pipe is provided with an elevation which is positioned above any portion of the fuel supply pipe. It is preferable that the fuel supply pipe has a section formed into a U-shape and the air pipe is connected to a trough of the U-shaped section of the fuel supply pipe.

The fuel supply system of the present invention may further include an outflow prevention mechanism for preventing fuel oil from flowing out through the air pipe to a section of the oil burner other than the combustion section due to clogging of the tip end of the fuel supply pipe with tar or the like. In a preferred embodiment of the present invention, the fuel supply pipe is provided at a portion thereof between the connection and the combustion section with an elevation and the air pipe is provided with an elevation. The elevation of the fuel oil pipe is positioned so as to be constantly above a level of fuel oil in the air pipe during normal combustion operation. The outflow prevention mechanism is formed by positioning the elevation of the fuel supply pipe above the connection so as to lower the level of fuel oil in the air pipe below the elevation of the fuel supply pipe during combustion operation, positioning the elevation of the air pipe above the elevation of the fuel supply pipe and arranging a return pipe between the oil reservoir and the fuel supply pipe, the return pipe having an elevation positioned between the elevation of the air pipe and that of the fuel supply pipe.

Alternatively, the outflow prevention mechanism may comprise a sensor means for detecting a variation in a level of fuel oil in the air pipe.

Accordingly, it is an object of the present invention to provide a fuel supply system for an oil burner which is capable of effectively preventing the generation of bad odor during and after a fire-extinguishing operation of the oil burner.

It is another object of the present invention to provide a fuel supply system for an oil burner which is capable of preventing the generation of bad odor during and after the fire-extinguishing with a simple structure.

It is a further object of the present invention to provide a fuel supply system for an oil burner which is capable of positively preventing the outflow of fuel oil through the fuel supply system to a section of the oil burner other than a combustion section irrespective of any trouble while constantly preventing the generation of bad odor during the fire-extinguishing.

It is still another object of the present invention to provide a fuel supply system for an oil burner which is capable of effectively preventing the outflow of fuel oil through the fuel supply system to a section of the oil burner other than a combustion section thereof even when a tip end of a fuel supply pipe is clogged with tar or the like as well as preventing the generation of bad odor.

It is yet another object of the present invention to provide a fuel supply system for an oil burner which is capable of preventing the outflow of fuel oil from the fuel supply system when a tip end of a fuel supply pipe is clogged with tar or the like with a simple structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is made to the following description taken in connection with the accompanying drawings in which like reference numerals designate like or corresponding parts throughout; wherein.

DETAILED DESCRIPTION OF THE PREFERRED EMBODIMENT

Now, a fuel supply system for an oil burner according to the present invention will be described hereinafter with reference to the accompanying drawings.

Figure 1:
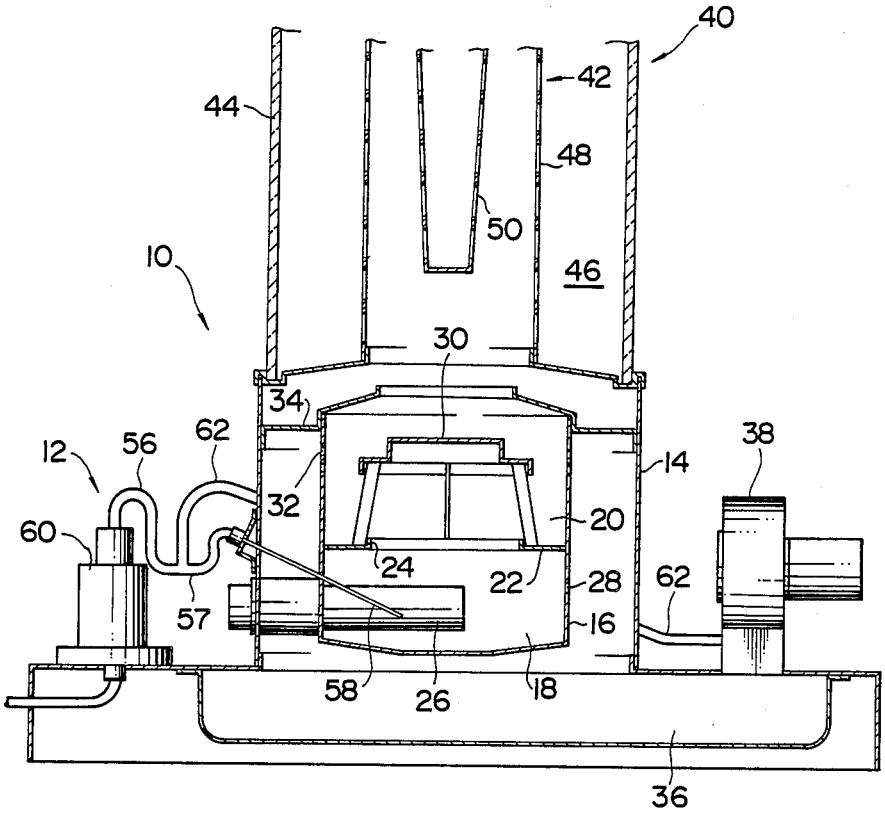
FIG. 1 is a fragmentary vertical sectional view showing an oil burner in which an embodiment of a fuel supply system according to the present invention is incorporated.

FIG. 1 illustrates an example of an oil burner in which a fuel supply system according to the present invention is adapted to be incorporated. In FIG. 1, an oil burner and a fuel supply system are generally designated by reference numerals 10 and 12, respectively. The oil burner 10 is in the form of a pot-type red-heated oil burner. However, it should be noted that an oil burner to which a fuel supply system of the present invention is applied is not limited to such a pot-type oil burner.

The pot-type oil burner 10 per se may be constructed in a manner widely known in the art. More particularly, the oil burner 10 includes a housing 14 of a substantially cylindrical shape and a combustion section 16 housed in the housing 14. In the example, the combustion section 16 comprises a pot. The pot 16 is adapted to carry out therein the vaporization, ignition and combustion of fuel oil such as kerosene fed thereto by means of the fuel supply system 10 of the present invention described hereinafter. For this purpose, the pot 16 has a lower chamber 18 for the vaporization and ignition of fuel oil and an upper chamber 20 for the combustion of fuel oil confined therein, which are separated from each other by a horizontal partition 22. The partition 22 is formed at a central portion thereof with an opening 24 through which the chambers 18 and 20 are communicated to each other. Arranged in the lower chamber 18 is an electric heater 26 which serves to heat fuel oil fed to the pot 16 to vaporize it and ignite the vaporized fuel oil using air fed from through-holes 28 formed at a side wall of the lower chamber 18.

The upper chamber 20 has a plate means 30 supported on the partition 22 and positioned above the opening 24. The plate means 30 is formed into an inverted dish shape and acts to spread a flame of fuel oil ignited in the lower chamber 18 and cause combustion of fuel oil to be carried out in the upper chamber 20 using air fed to the chamber 20 via a plurality of through-holes 32 formed at a side wall of the chamber 20.

In the example, the pot 16 is suspended in the housing 14 by means of a top plate 34 of the pot 16 outwardly extending from the pot 16 to the housing 14, so that an air passage 36 may be defined between the housing 14 and the pot 16 for feeding air from an air fan 38 therethrough to the pot 16. For this purpose, the air passage 36 is communicated via through-holes 28 and 32 to the pot 16.

Further, the oil burner 10 includes a combustion cylinder construction 40 arranged above the pot 16 in a manner to be communicated to the pot 16. The combustion cylinder construction 40 is adapted to complete therein combustion of fuel oil started in the pot and discharge heat rays to an exterior of the oil burner. The combustion cylinder construction 40 includes a cylinder means 42 and a heat-permeable cylinder 44 with a space 46 being defined therebetween. The cylinder means 42 comprises an outer perforated cylinder 48 and an inner perforated cylinder 50. Combustion completed in the construction 40 causes the cylinder means 42 to be red-heated to a degree sufficient to outwardly emit heat rays therefrom through the heatpermeable cylinder 44. Combustion gas produced due to the combustion is upwardly discharged from the construction 40 to a room.

Furthermore, the oil burner 10 has an oil reservoir 52 arranged at a lower section thereof which is adapted to store fuel oil 54 therein.

The fuel supply system 12 of the illustrated embodiment which is incorporated in the oil burner 10 described above, as shown in FIG. 1, includes a fuel supply pipe 56 arranged between the oil reservoir 52 and the pot 16 in a manner to be communicated with both. In the illustrated embodiment, the fuel supply pipe 56 has a section 57 formed at a middle thereof into a U-shape. Also, the fuel supply pipe 56 is provided at a tip end thereof with a nozzle 58 which is in the form of a pipe-like shape and serves to eject fuel oil in the form of a drizzle-like shape into the pot 16.

The fuel supply system 12 also includes a pump 60 arranged between the fuel supply pipe 56 and the oil reservoir 52 to draw fuel oil 54 from the oil reservoir 52 to the fuel supply pipe 56. The pump 60, in the illustrated embodiment, comprises an electromagnetic pump which is adapted to stop the drawing-up of fuel oil when its actuation is stopped.

Connected between the fuel supply pipe 56 and an inlet side of the air passage 36 is an air pipe 62. The air pipe 62 is formed and arranged so as to have an elevation positioned above any portion of the fuel supply pipe, particularly, any portion of a section of the fuel supply pipe 56 between the air pipe 62 and the pot 16. In the illustrated embodiment, the air pipe 62 is connected to a trough of the U-shaped section 57 of the fuel supply pipe 56. However, in the illustrated embodiment, it should be noted that the formation of the fuel supply pipe 56 into a U-shape and the connection of the air pipe to the trough of the U-shaped section 57 are not essential to the present invention, so long as the air pipe 62 has the elevation positioned above any portion of the fuel supply pipe or at least any portion of the section of the fuel supply pipe 56 between the air pipe 62 and the pot 16, as described above.

Now, the manner of operation of the fuel supply system of the illustrated embodiment will be described hereinafter with reference to FIG. 1.

First, the pot 16 is heated to a required temperature by means of the heater 26 and then the pump 60 and air fan 38 are actuated to feed fuel oil from the oil reservoir 52 to the pot 16 and combustion air through the air passage 36 to the pot, respectively. The so-fed fuel oil is ignited and combustion is carried out using the combustion air in the heated pot 16 and combustion cylinder construction 40, so that the cylinder means 42 may be redheated to discharge heat rays therefrom through the heatpermeable cylinder 44 to a room.

During the combustion operation, a level of fuel oil in the air pipe 62 is kept below the highest portion of the fuel supply pipe 56 between the air pipe 62 and the pot 16 because the elevation of air pipe 62 is positioned above the highest portion of the fuel supply pipe 56 and air pressure is applied to the air pipe 62 through the air passage 36 from the air fan 38. This is more effectively accomplished by connecting the air pipe 62 to the bottom of the U-shaped section 57 of the fuel supply pipe 56.

Thereafter, when the pump 60 is stopped and the air fan 38 is turned off for fire-extinguishing of the oil burner, air pressure in the air pipe 62 is decreased toward atmospheric pressure. This results in the oil level in the air pipe 62 rising because fuel oil remaining in the portion of the fuel supply pipe 56 between the air pipe 62 and the pot 16 flows into the air pipe due to the decrease in pressure in the air pipe and the stop of the pump 60. When the pressure in the air pipe is decreased to the same level as atmospheric pressure, the nozzle pipe 58 is rendered substantially free of fuel oil. The above is more effectively promoted by providing the fuel supply pipe 56 with the U-shaped section 57.

Thus, it will be noted that the embodiment described above effectively accomplishes the prevention of generation of bad odor during and after the fire-extinguishing.

Figure 2:
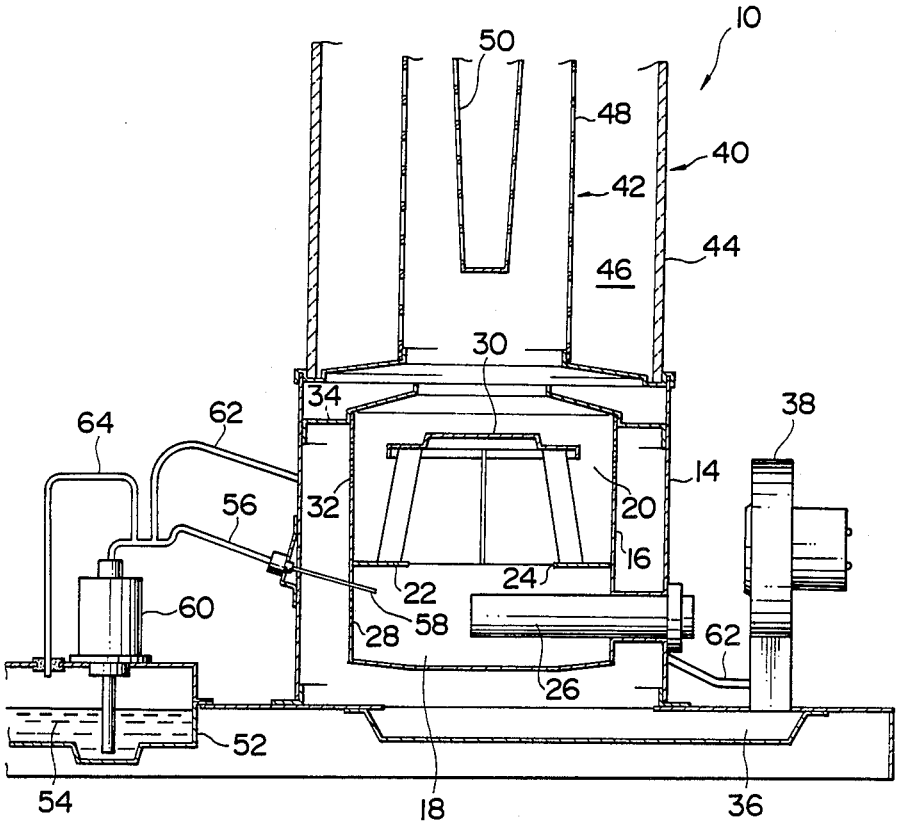
FIG. 2 is a fragmentary vertical sectional view showing an oil burner in which another embodiment of a fuel supply system of the present invention is incorporated.
Figure 3:
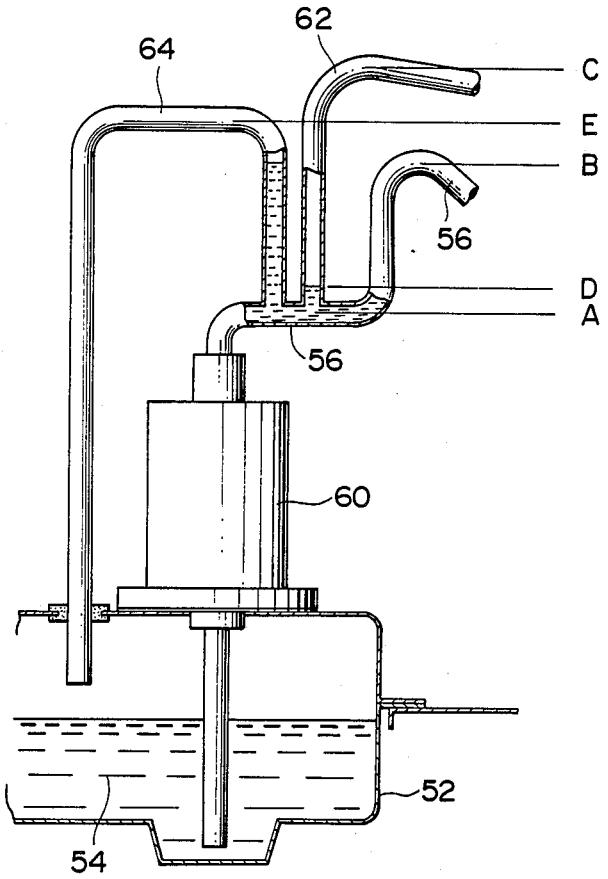
FIG. 3 is a schematic front view partly in section showing the embodiment of FIG. 2.

FIGS. 2 and 3 illustrate another embodiment of a fuel supply system according to the present invention, which is adapted to prevent the outflow of fuel oil through an air pipe while preventing the generation of bad odor during the fire-extinguishing. More particularly, the fuel supply system shown in FIGS. 2 and 3 includes an overflow prevention mechanism for preventing fuel oil from flowing through the air pipe, which is indicated at reference characters A to C in FIG. 3. More particularly, A designates a connection between an air pipe 62 and a fuel supply pipe 56, B indicates an elevation provided at a portion of the fuel supply pipe 56 between the connection A and a pot 16, and C is an elevation provided at the air pipe 62. Positional relationships among A, B and C is that the elevation B is defined above the connection A and the elevation C is positioned above the elevation B. Also, the elevation B is formed so as to be constantly above a level of fuel oil in the air pipe 62 during normal combustion operation of an oil burner.

Such positional relationships as described above results in fuel oil in the air pipe 62 being constantly kept at a level D below the elevation B of the fuel supply pipe 6 due to air pressure applied to the air pipe 62 from an air fan 38 through an air passage 36 although fuel oil enters the air pipe, so that the flow of fuel oil through the air pipe 62 to a section other than the pot 16 may be effectively prevented during the combustion operation of the oil burner.

The fuel supply system of the illustrated embodiment further includes a return pipe 64 for connecting the fuel supply pipe 56 directly or indirectly to an oil reservoir 52. The return pipe 64 has an elevation E positioned between the elevation B of the fuel supply pipe 56 and the elevation C of the air pipe 62, so that even when excessive rising of an oil level occurs in the air pipe 62, the return pipe 64 provides a way out to prevent fuel oil from flowing out through the air pipe. The remaining part of the embodiment shown in FIGS. 2 and 3 may be constructed in substantially the same manner as that of FIG. 1.

In the embodiment shown in FIGS. 2 and 3, during the combustion operation of an oil burner 10, the air fan 38 constantly applies air pressure to the air pipe 62 through the air passage 36, resulting in the level D of fuel oil in the air pipe 62 being constantly kept below the elevations B and C. When the fuel supply pipe 56 is clogged at its tip end or nozzle 58 with tar or the like, it fails to flow fuel oil to the pot 16, to thereby cause the level D to rise. Nevertheless, the drawing-up of fuel oil to the fuel supply pipe by a pump 60 is continued. However, at this time, the level D reaches the elevation E of the return pipe 64 before it rises to the elevation C of the air pipe 62, so that fuel oil drawn up by the pump 60 may be effectively returned through the return pipe 64 to the oil reservoir 52 to prevent any fuel oil from flowing out through the air pipe.

Figure 4:
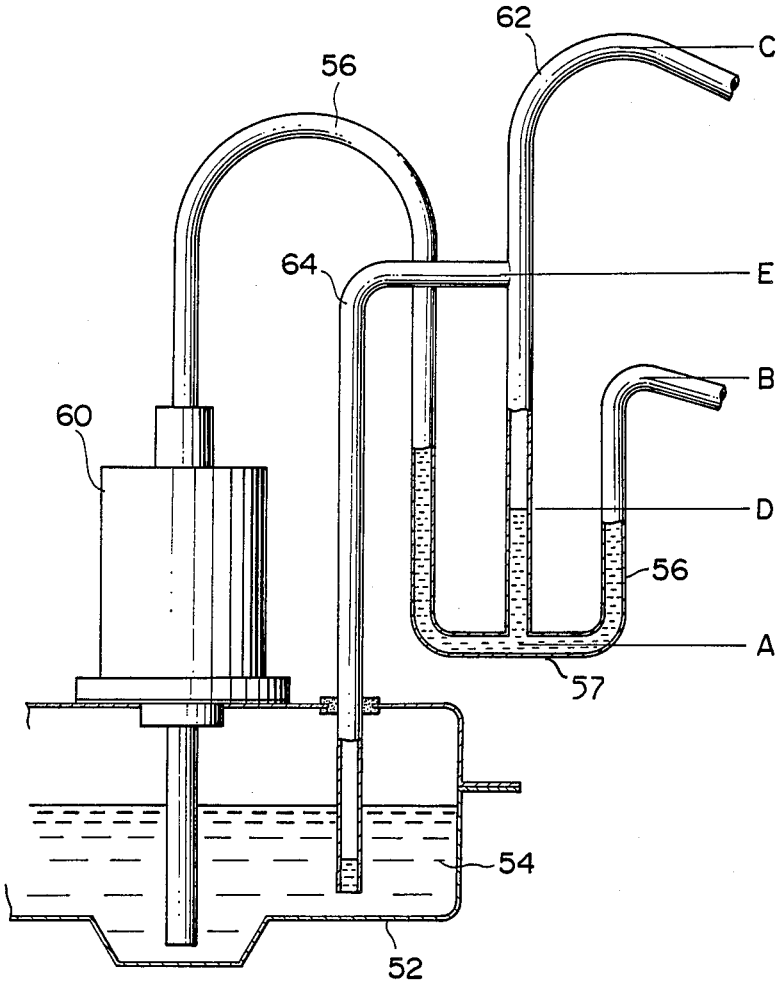
FIG. 4 is a fragmentary front elevation view partly in section showing a modification of the embodiment shown in FIG. 2.

FIG. 4 illustrates a modification of the abovedescribed embodiment shown in FIGS. 2 and 3. The modification is so constructed that a return pipe 64 is connected at one end thereof to an air pipe 62 between an elevation C of the air pipe and a connection A to more simplify the construction of the fuel supply system. It is preferable that the return pipe 64 is constantly immersed at the other end thereof in fuel oil 54 in the oil reservoir 52. This causes a level of fuel oil in a portion of the return pipe 64 immersed in the fuel oil 54 in the oil reservoir to be constantly below a level of the fuel oil 54 in the oil reservoir as shown in FIG. 4 due to the application of air pressure to the return pipe 64 through the air pipe 62 from an air fan, to thereby effectively prevent air pressure applied to the air pipe from leaking through the return pipe. Also, in the modification shown in FIG. 4, the fuel supply pipe 56 is formed at a part thereof into a U-shape and the air pipe 62 is connected to a bottom of the U-shaped section 57 of the fuel supply pipe. The remaining part of the modification may be constructed in substantially the same manner as the embodiment of FIGS. 2 and 3.

Figure 5:
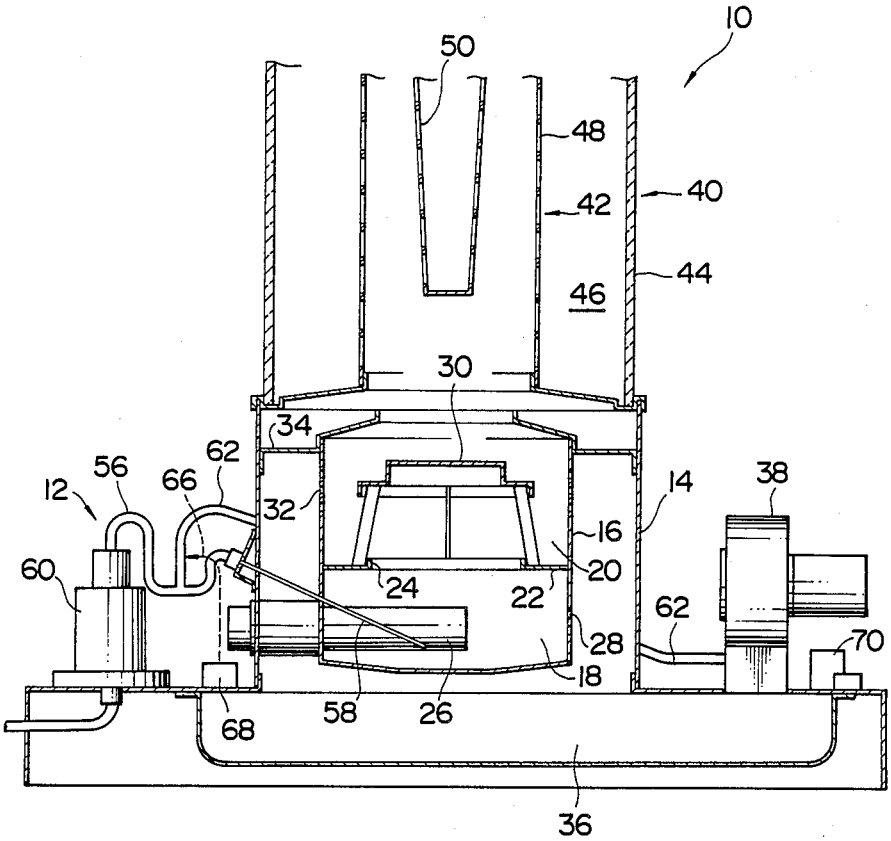
FIG. 5 is a fragmentary vertical sectional view showing an oil burner in which another embodiment of a fuel supply system according to the present invention is incorporated.
Figure 6:
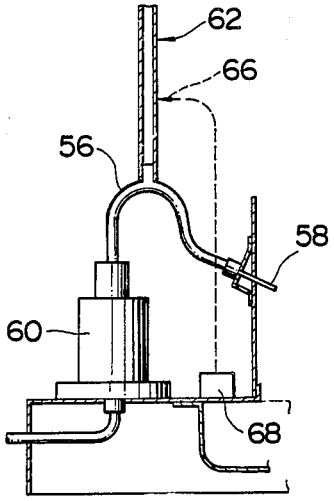
FIG. 6 is a schematic view partly in section showing an example of a sensor means employed in the embodiment shown in FIG. 5.

FIG. 5 shows another embodiment of a fuel supply system for an oil burner according to the present invention. In the embodiment of FIG. 5, an outflow prevention mechanism comprises a sensor means 66 for detecting a variation in a level of fuel oil in an air pipe 62. The sensor means 66 is connected to an alarm means 68 and adapted to actuate the alarm 68 when it detects the variation. Alternatively, the sensor means 66 may be connected to an automatic fire-extinguishing device. The sensor means 66 may comprise a suitable level sensor arranged in the air pipe 62. Alternatively, it may be constructed in such a manner as shown in FIG. 6. More particularly, in FIG. 6, a part of the air pipe 62 may be formed of a transparent material and a photosensor is arranged on an outside of the transparent portion of the air pipe to detect the variation therethrough. As shown in FIG. 5, an oil burner 10 having the fuel supply system of the illustrated embodiment may include a vibration sensing device 70 which serves to stop combustion operation of the oil burner when it detects vibration due to an earthquake or the like. The remaining part of the fuel supply system of the illustrated embodiment may be constructed in substantially the same manner as that shown in FIG. 1.

In the embodiment of FIG. 5 constructed as described above, the sensor 66 detects a variation in a level of fuel oil in the air pipe 62 which is caused due to clogging of a tip end of the fuel supply pipe 56 or a nozzle 58 with tar and actuates the alarm 68. This results in a user noticing the abnormality to prevent fuel oil from flowing out through the air pipe.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A fuel supply system for an oil burner which includes an oil reservoir, a combustion section, an air passage and an air fan for forcibly supplying combustion air through said air passage to said combustion section, comprising:

a fuel supply pipe connected between said oil reservoir and said combustion section to feed fuel oil from said oil reservoir to said combustion section therethrough;

a pumping means for drawing fuel oil from said oil reservoir to said fuel supply pipe; and an air pipe connected at one end thereof to said fuel supply pipe through a connection therebetween and at the other end thereof to an inlet side of said air passage;

said air pipe being provided with an elevation positioned above any portion of said fuel supply pipe, and said connection between said air pipe and said fuel supply pipe providing open fluid communication therebetween.

2. A fuel supply system as defined in claim 1, wherein said fuel supply pipe has a section formed into a U-shape and said air pipe is connected to a trough of said U-shaped section.

3. A fuel supply system as defined in claim 1 further comprising an outflow prevention mechanism for preventing fuel oil from flowing out through said air pipe to a section of said oil burner other than said combustion section due to clogging of a tip end of said fuel supply pipe.

4. A fuel supply system as defined in claim 3, wherein said fuel supply pipe is provided at a portion thereof between said connection and said combustion section with an elevation;

said outflow prevention mechanism being formed by positioning said elevation of said fuel supply pipe above said connection between said fuel supply pipe and said air pipe so as to lower a level of fuel oil in said air pipe below said elevation of said fuel supply pipe during combustion operation, positioning said elevation of said air pipe above said elevation of said fuel supply pipe and arranging a return pipe between said oil reservoir and said fuel supply pipe, said return pipe having an elevation positioned between said elevation of said air pipe and that of said fuel supply pipe.

5. A fuel supply system as defined in claim 4, wherein said return pipe is connected at one end to said fuel supply pipe through said air pipe so that a portion of said air pipe between said return pipe and said connection may act as a part of said return pipe and dipped at the other end thereof in fuel oil stored in said oil reservoir.

6. A fuel supply system as defined in claim 3, wherein said outflow prevention mechanism comprises a sensor means for detecting a variation in a level of fuel oil in said air pipe.

7. A fuel supply system as defined in claim 6, wherein said sensor means comprises a level sensor arranged in said air pipe.

8. A fuel supply system as defined in claim 6, wherein said sensor means a photosensor arranged on an outside of a transparent portion of said air pipe.

9. A fuel supply system as defined in any one of claims 6 to 8, wherein said sensor means is connected to an alarm.

10. A fuel supply system for an oil burner which includes an oil reservoir, a combustion section, an air passage and an air fan for forcibly supplying combustion air through said air passage to said combustion section, comprising:

a fuel supply pipe connected between said oil reservoir and said combustion section to feed fuel oil from said oil reservoir to said combustion section therethrough;

a pumping means for drawing fuel oil from said oil reservoir to said fuel supply pipe;

an air pipe connected at one end thereof to said fuel supply pipe through a connection therebetween and at the other end thereof to an inlet side of said air passage to cause air pressure to be applied to said air pipe, said air pipe being provided with an elevation positioned above any portion of a section of said fuel supply pipe between said air pipe and said combustion section;

said fuel supply pipe being provided at a portion thereof between said connection and said combustion section with an elevation; and an outflow prevention mechanism for preventing fuel oil from flowing out through said air pipe to a section of said oil burner other than said combustion section due to clogging of a tip end of said fuel supply pipe;

said outflow prevention mechanism being constructed by positioning said elevation of said fuel supply pipe above said connection so as to lower a level of fuel oil in said air pipe below said elevation of said fuel supply pipe during combustion operation, positioning said elevation of said air pipe above said elevation of said fuel supply pipe and arranging a return pipe between said oil reservoir and said fuel supply pipe, said return pipe having an elevation positioned between said elevation of said air pipe and that of said fuel supply pipe.

11. A fuel supply system for an oil burner which includes an oil reservoir, a combustion section, an air passage and an air fan for forcibly supplying combustion air through said air passage to said combustion section, comprising:

a fuel supply pipe connected between said oil reservoir and said combustion section to feed fuel oil from said oil reservoir to said combustion section therethrough;

a pumping means for drawing fuel oil from said oil reservoir to said fuel supply pipe;

an air pipe connected at one end thereof to said fuel supply pipe through a connection therebetween and at the other end thereof to an inlet side of said air passage to cause air pressure to be applied to said air pipe, said air pipe being provided with an elevation positioned above any portion of a section of said fuel supply pipe between said air pipe and said combustion section; and an outflow prevention mechanism for preventing fuel oil from flowing out through said air pipe to any section of said oil burner other than said combustion section due to clogging of a tip end of said fuel supply pipe;

said outflow prevention mechanism comprising a sensor means for detecting a variation in a level of fuel oil in said air pipe and an alarm.

* * * * *